US005515150A

United States Patent [19]

Yoshie et al.

[11] Patent Number: 5,515,150

[45] Date of Patent: May 7, 1996

[54] COPYING APPARATUS EQUIPPED WITH AUTOMATIC DOCUMENT FEEDER FOR FEED CUT SHEETS AND CONTINUOUS FEED SHEETS

[75] Inventors: Koji Yoshie; Yasushi Yamada; Hiroyuki Wakabayashi, all of Hachioji, Japan

[73] Assignee: Konica Corporation, Tokyo, Japan

[21] Appl. No.: 228,422

[22] Filed: Apr. 15, 1994

[30] Foreign Application Priority Data

May 12, 1993 [JP] Japan ..... 5-110688

[51] Int. Cl.[6] ..... G03G 21/00

[52] U.S. Cl. ..... 355/308; 355/321

[58] Field of Search ..... 355/308, 309, 355/311, 318, 321, 322, 75; 271/3; 226/108–110, 118

[56] References Cited

U.S. PATENT DOCUMENTS

| | | | |
|---|---|---|---|
| Re. 31,891 | 5/1985 | Tickner et al. | 355/75 |
| 3,997,093 | 12/1976 | Aizawa et al. | 226/11 |
| 4,087,172 | 5/1978 | Van Dongen | 355/75 X |
| 4,579,326 | 4/1986 | Pinckney et al. | 271/3.1 |
| 4,635,916 | 1/1987 | Modugno et al. | 271/3 |
| 4,664,509 | 5/1987 | Christy et al. | 355/75 |
| 4,993,701 | 2/1991 | Tosserams | 271/207 |
| 5,081,487 | 1/1992 | Hoyer et al. | 355/75 |
| 5,200,790 | 4/1993 | Irie et al. | 355/308 |

FOREIGN PATENT DOCUMENTS

| | | |
|---|---|---|
| 61-179466 | 8/1986 | Japan . |
| 61-183031 | 8/1986 | Japan . |
| 1-197246 | 8/1989 | Japan . |

*Primary Examiner*—Robert Beatty

*Attorney, Agent, or Firm*—Finnegan, Henderson, Farabow, Garrett & Dunner

[57] ABSTRACT

A copying apparatus provided with an automatic document feeder having two sheet-discharging modes. One is a first-discharging mode in which a cut-sheet document subjected to exposure processing in an image reading section is conveyed to a sheet discharge section disposed on the downstream side, and the document is inverted in the sheet discharging section and then discharged to the outside of the apparatus. The other is a second sheet-discharging mode in which a continuous document is discharged from the sheet discharge section to the outside of the apparatus. The copying apparatus includes a pair of carrying-out rollers disposed on the downstream side of the image reading section in the sheet discharging section, and also includes a pair of reversible inversion conveyance rollers, and further includes a sheet discharge tray disposed on the downstream side of the inversion conveyance rollers, wherein a nip position of the pair of inversion conveyance rollers is disposed at a position higher than a nip position of the pair of carrying-out rollers on the upstream side.

15 Claims, 12 Drawing Sheets

COPYING APPARATUS EQUIPPED WITH AUTOMATIC DOCUMENT FEEDER FOR FEED CUT SHEETS AND CONTINUOUS FEED SHEETS

BACKGROUND OF THE INVENTION

The present invention relates to improvements in an automatic document feeder used for a recording device or an image reading device provided in an electrophotographic copying apparatus, and more particularly relates to improvements in a circulation type automatic document feeder having a document feeding mode of ADF or R-ADF in which one-sided or two-sided documents stacked on a document stack section are separated from the document stack one by one and fed to an image reading section and then the documents are discharged onto a discharging tray. Further, the present invention relates to improvements in a circulation type automatic document feeder having a one-sided document circulation conveyance mode (RDH mode) in which a read document is returned to the document stack section so that it can be repeatedly fed. Furthermore, the present invention relates to improvements in a circulation type automatic document feeder having a two-sided document reversal circulation conveyance mode (R-RDH mode), a computer form feeding mode (CFF mode), and a manual feeding document feed mode.

An automatic document feeder (ADF) that can efficiently and automatically feed a document on which an image is recorded, has already been provided to a recording device installed in an electrophotographic copying apparatus or a recorded image reading apparatus.

An automatic document feeder (R-ADF) having a reversal function by which a document is reversed, is put into practical use as a copying apparatus by which the images on a two-sided document are copied onto one side or both sides of a recording sheet and as an image reading apparatus by which the images are read.

Also, a circulation type automatic document feeder (RDH) has been proposed in which the documents stacked on a document stack section are separated one by one and automatically fed onto a platen glass and the document exposed to light on the platen glass is returned to the document stack section so that the document can be repeatedly processed. By this circulation type automatic document feeder (RDH), a copy is made when a document is circulated once, so that the document is circulated by the number of required copies. For example, the above technique is disclosed in Japanese Patent Publication Open to Public Inspection Nos. 179466/1986 (U.S. appln No. 678861, Priority date: Dec. 6, '84) and 183031/1986 (U.S. appln No. 678863, Priority date: Dec. 6, '84).

Moreover, a circulation type automatic document feeder (R-RDH) has been also provided in which a document reversal mechanism is added to the RDH described above (disclosed in Japanese Patent Application Open to Public Inspection No. 197246/1989).

With these circulation type automatic document feeders (RDH and R-RDH), which will be referred to as RDH hereinafter, it is possible to conduct a high speed continuous copying operation and to quickly collate copied recording sheets. Moreover, when the circulation type automatic document feeder (RDH) is combined with a finisher device by which stapling and punching operations are conducted on the recording sheets, the overall recording operation can be automatically performed.

Recently, there is provided an automatic document feeder having a continuous sheet conveyance device by which a perforated and folded continuous sheet can be conveyed, wherein this perforated and folded continuous sheet is referred to as a computer output fan folded sheets, a continuous sheet document or a CCF document in this specification, hereinafter.

However, the following problems may be encountered in the above conventional automatic document feeder.

(1) When a CCF document feeder is provided in the above automatic document feeder, the construction becomes complicated, so that the size and weight of the feeder are increased. Accordingly, it is difficult for an operator to handle the automatic document feeder when he lifts it to open the platen glass surface. Therefore, the operation of jam clearance becomes difficult, and further it requires much labor.

In the above automatic document feeder, there are provided a pair of rollers for inverting documents in the sheet discharging section. In this case, an upper roller on the drive side and a lower roller on the idle side are separately attached onto the automatic document feeder side and the apparatus main body side. Therefore, when the automatic document feeder is set on the copying apparatus main body, the pair of rollers can not be accurately aligned, and a positional error is created, so that a nip line formed by the upper and lower rollers fluctuates, and conveyed documents are skewed.

(3) Conventionally, the pair of rollers for inverting the document and a pair of rollers provided on the upstream side of document conveyance are located on the same horizontal line. Accordingly, when a curled document is switched back, it is caught by a gate member for changing over a conveyance passage. Therefore, the document is jammed, and it can not be appropriately inverted.

(4) In general, a sheet discharging tray provided in the sheet discharging section of the automatic document feeder is thin and long, and supported by and protruded from a casing of the automatic document feeder in the manner of a cantilever. Accordingly, the sheet discharging tray tends to be bent. For this reason, when a large number of documents (for example, about 100 sheets of documents) are stacked on the sheet discharging tray, it is deformed by the weight of documents. Therefore, the stacked documents are not appropriately aligned. Further, when a force is mistakenly applied to this protruded sheet discharging tray, it may be damaged.

(5) In the case where upper and lower sheet discharging trays are provided in the automatic document feeder, a CFF document is sent to a sheet discharging passage between the upper and lower sheet discharging trays. In this construction, the upper sheet discharging tray and gate plate must be withdrawn in the case of jam clearance. Accordingly, the structure becomes complicated, and the reliability of document conveyance is deteriorated.

(6) According to this structure, in the case where a CFF document is discharged, an upper portion of the sheet discharging tray is open, and there is no member to guide the document. As a result, the CFF document jumps out from the sheet discharging tray, and can not be appropriately folded.

(7) There is provided a copying machine constructed in such a manner that a sorter is attached onto the side and CFF documents are discharged from the sheet discharge section to the sorter, and a CFF document tray is disposed on the outside of the sorter. According to the above structure, the installation space is increased, and further the number of parts is increased for installing the CFF document tray, which raises the manufacturing cost.

SUMMARY OF THE INVENTION

In order to solve the above problems, the first embodiment of the present invention is a copying apparatus provided with an automatic document feeder having two sheet-discharging modes. One is a first sheet-discharging mode in which a cut-sheet document subjected to exposure processing in an image reading section is conveyed to a sheet discharge section disposed on the downstream side, and the document is inverted in the sheet discharge section and then discharged to the outside of the apparatus. The other is a second sheet-discharging mode in which a continuous document is discharged from the sheet discharge section to the outside of the apparatus. The copying apparatus includes a pair of carrying-out rollers disposed on the downstream side of the image reading section in the sheet discharging section, and also includes a pair of reversible inversion conveyance rollers, and further includes a sheet discharge tray disposed on the downstream side of the inversion conveyance rollers, wherein a nip position of the pair of inversion conveyance rollers is disposed at a position higher than a nip position of the pair of carrying-out rollers on the upstream side.

The second embodiment of the present invention is a copying apparatus provided with an automatic document feeder including: a pair of carrying-out rollers provided on the downstream side of the image reading section in the sheet discharge section; a pair of reversible inversion conveyance rollers also provided on the downstream side of the image reading section in the sheet discharge section; a sheet discharge tray provided on the downstream side of the inversion conveyance rollers; and an oscillatory branch guide plate disposed between the inversion conveyance rollers and the carrying-out rollers. When the first sheet discharge mode is set, a fore end of the branch guide plate is located at a lowered position, and the cut-sheet document carried out by the carrying-out rollers passes through the nip position of the inversion conveyance rollers and is reciprocated on the sheet discharge tray so that the document is inverted. When the second sheet discharge mode is set, a fore end of the branch guide plate is located at a rising position, and the continuous document carried out from the carrying-out rollers passes on the sheet discharge tray through a lower passage of the inversion conveyance rollers.

The third embodiment of the present invention is a copying apparatus provided with an automatic document feeder having three sheet-discharging modes. The first sheet-discharging mode is a mode in which a cut-sheet document subjected to exposure processing in an image reading section is conveyed to a sheet discharge section disposed on the downstream side, and the document is inverted in the sheet discharge section and then discharged to the outside of the apparatus. The second sheet-discharging mode is a mode in which a continuous document is discharged from the sheet discharge section to the outside of the apparatus. The third sheet-discharging mode is a mode in which a cut-sheet document subjected to exposure processing is discharged to the outside of the apparatus as it is. In the first sheet discharge mode, some of the cut sheet documents for inversion discharged from the sheet discharge section are temporarily accepted by the first tray, and in the second sheet discharge mode, a continuous document discharged from the sheet discharge section is guided by the first tray on the lower side. In the first sheet discharge mode, the cut sheet documents for inversion are accommodated on the second tray, and in the third sheet discharge mode, the cut sheet documents discharged from the sheet discharge section to the outside of the apparatus are accommodated on the second tray on the upper side. The third tray is supported by a fore end portion of the first tray on the downstream side, and capable of being oscillated downward. The copying apparatus of the third embodiment includes the aforementioned first, second and third trays. The copying apparatus of the third embodiment further includes an oscillatory guide member supported on the downstream side of the second tray. In the second sheet discharge mode, the continuous document discharged from the sheet discharge section is guided by an upper surface of the first tray, the oscillatory third tray and lower surface of the second tray, and the second guide member supported on the second tray in the oscillatory manner, so that the continuous document discharged from the sheet discharge section is discharged outside of the apparatus.

The fourth embodiment of the present invention is a copying apparatus provided with an automatic document feeder in which a folded type continuous document subjected to exposure processing in the image reading section is nipped and discharged by a pair of sheet discharge rollers in the sheet discharge section, and the continuous document is accommodated in an accommodation tray provided outside, through a sheet discharge tray provided outside of the apparatus. In this case, the folded type continuous document is discharged obliquely upward along a sheet discharge tray having an inclined guide surface, the downstream portion of which is located at a position higher than the nip position of the sheet discharge rollers.

DETAILED DESCRIPTION OF THE PREFERRED EMBODIMENTS

With reference to the attached drawings, an example of the copying apparatus having the automatic document feeder of the present invention will now be described as follows.

Figure 1:
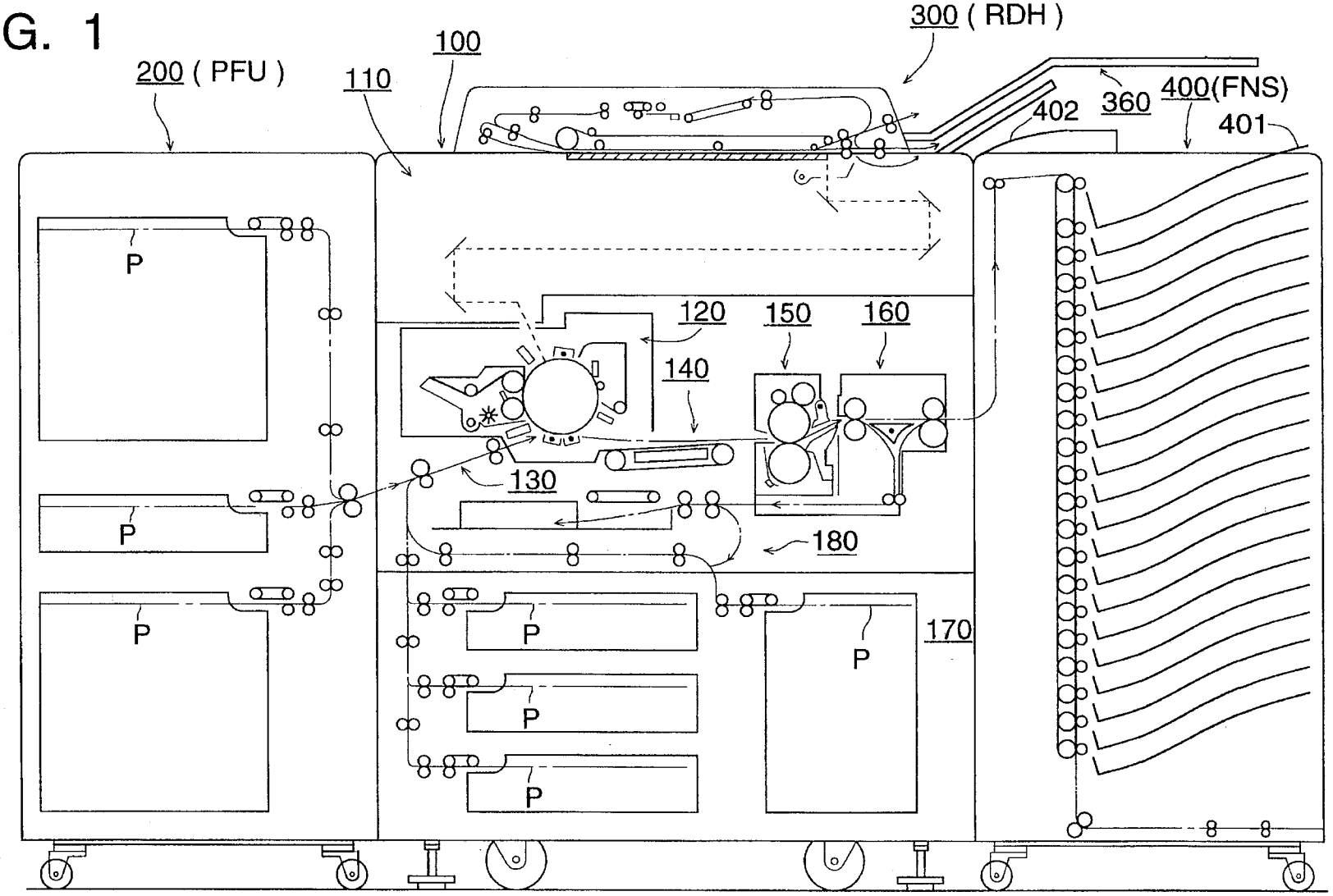
FIG. 1 is an overall arrangement view of a copying apparatus provided with an automatic document feeder of the present invention.

FIG. 1 is an overall arrangement view of a copying apparatus provided with an automatic document feeder, wherein numeral 100 is a copying apparatus body, numeral 200 is a sheet feeding unit, numeral 300 is a circulation type automatic document feeder (RDH device), and numeral 400 is a copy sheet after-processing device (a finisher, that is, a sorter having a stapler, which will be referred to as an FNS device, hereinafter).

The copying apparatus body 100 includes a scanning exposure section 110, image forming section 120, sheet feeding section 130, conveyance section 140, fixing section 150, discharged sheet switching section 160, a plurality of sheet feeding cassettes 170, and copy sheet refeeding device (ADU device) 180 for two-sided copying.

In the drawing, a one-dotted chain line shows a conveyance passage for copy sheets P. As illustrated in the drawing, the conveyance passage is composed of a main route and a circulation route. According to the main route, an image is formed on a copy sheet P accommodated in the sheet feed cassette 170 provided in the lower portion of the copying apparatus body 100 or accommodated in the sheet feed unit (PFU) 200, and then the copy sheet P passes through the conveyance section 140, fixing section 150 and discharged sheet switching section 160 and is accommodated in the FSN device 400. According to the circulation route, the copy sheet P branches from the main route by the action of the discharged sheet switching section 160, and is temporarily stored in the ADU device 180 and then conveyed to the sheet feed section 130 of the copying apparatus body 100 again.

Figure 2:
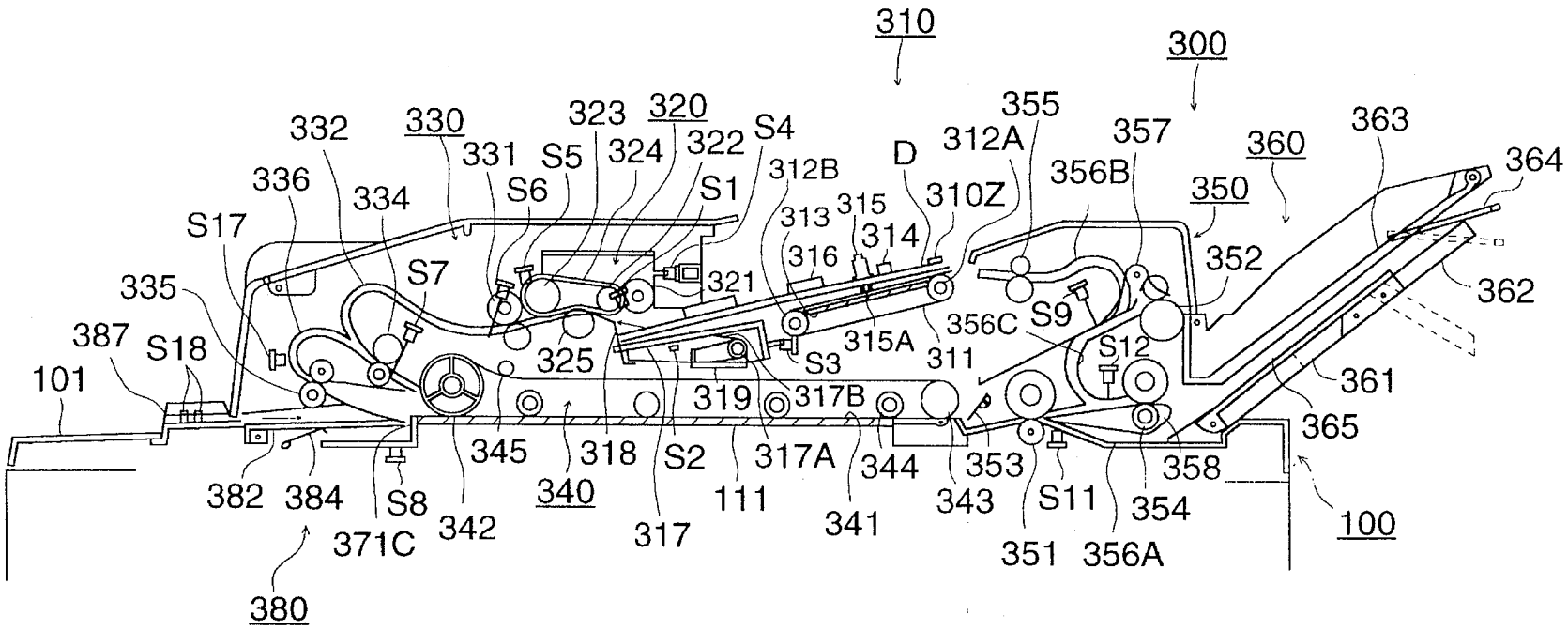
FIG. 2 is a sectional view of the automatic document feeder.
Figure 3:
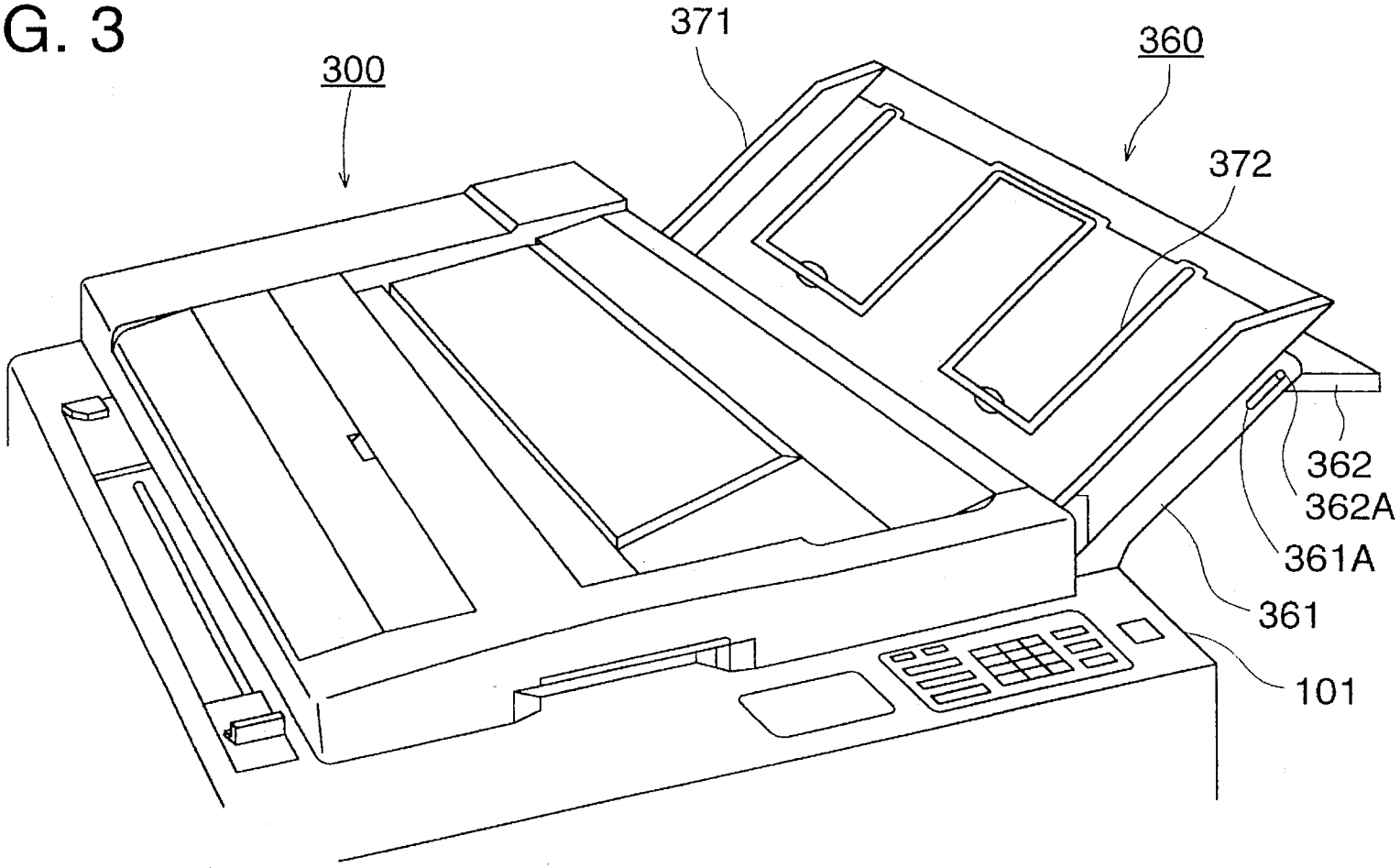
FIG. 3 is a perspective view of the automatic document feeder.

FIG. 2 is a sectional view of an automatic document feeder 300 attached to the upper portion of the copying apparatus body 100. FIG. 3 is its perspective view. The automatic document feeder 300 to which the present invention can be applied is provided with the functions of circulation types of RDH and R-RDH modes in which a plurality of documents (one-sided or two-sided documents) are conveyed to the exposure section on the platen glass 111 of the copying apparatus body 100 from the document stack section 310 and then conveyed again onto the document stack section 310. Also, the automatic document feeder 300 to which the present invention can be applied is provided with the functions of the ADF mode, R-ADF mode, manual document feeding mode, and CFF mode.

The automatic document feeder 300 includes the document stack section 310, feed section 320, intermediate conveyance section 330, conveyance section 340 and sheet discharging and reversal section 350.

When a document stack D is set on the document stack section 310, the existence of documents is detected by a document set detection sensor S1, and ADF mode is displayed on the control panel according to the result of the detection. When the document stack D is set at a predetermined position, the document size (B5 to A3) is detected by a document size sensor S2 and inputted into the control section of the copying apparatus body 100.

At the end of the document stack section 310 on the downstream side of document flow, a movable pushing plate 317 is pivotally provided around an oscillation shaft 317A. A drive plate 319 is secured to the oscillation shaft 317A with screws. Accordingly, the drive plate 319 can be oscillated integrally with the oscillation shaft 317A. A resilient deformation member (for example, a torsion spring) 317B is wound around the oscillation shaft 317A, so that the drive plate 319 can be pushed by both ends of the oscillation shaft 317A, and the movable pushing plate 317 can be pushed by the central portion of the oscillation shaft 317A.

An actuator section attached to the drive plate 319 turns on and off the optical path of the pressure home position sensor S3 secured to the fixed bottom plate, so that the home position of the drive plate 319 is detected.

Figure 4:
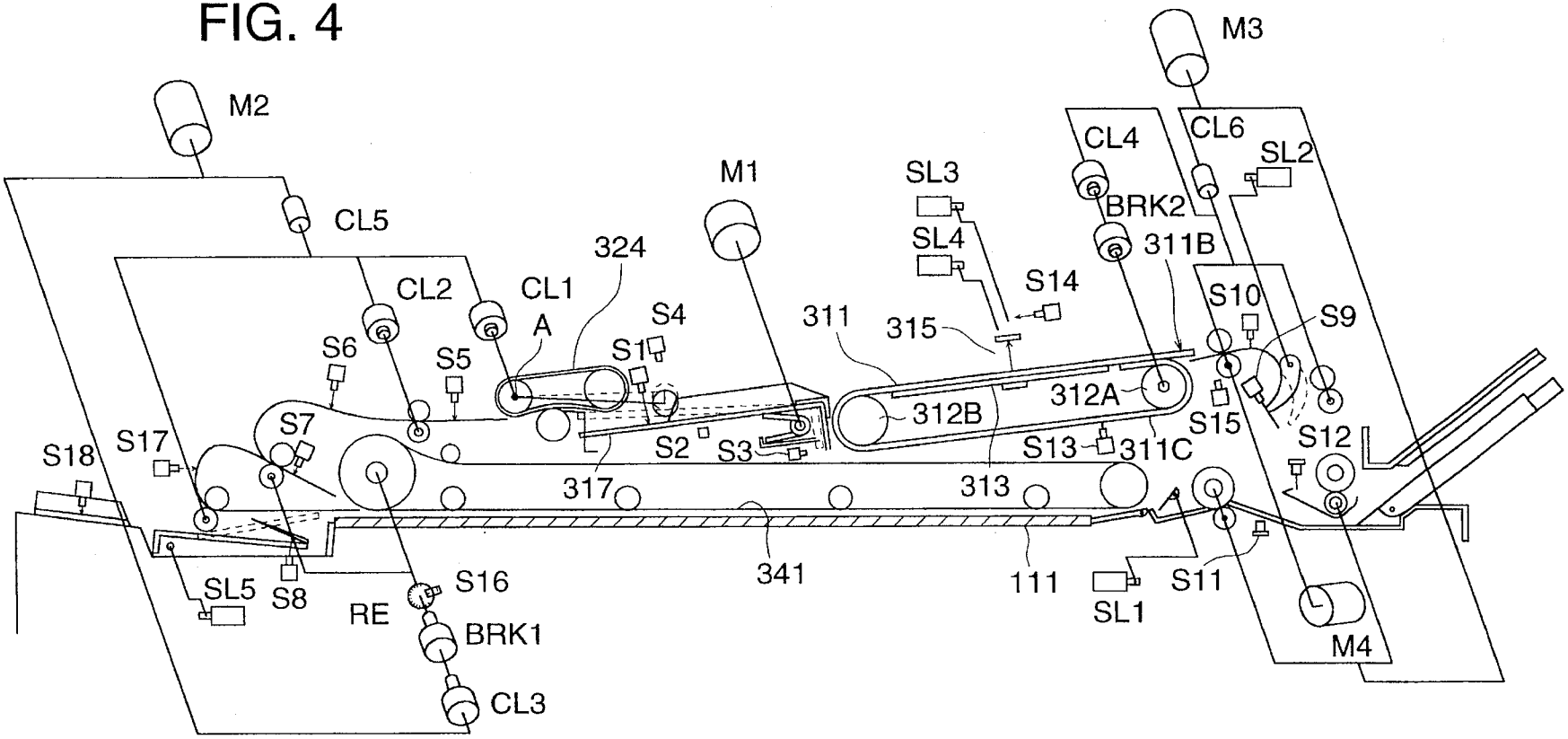
FIG. 4 is an arrangement view showing the drive system of the automatic document feeder.

FIG. 4 is a view showing the construction of the drive system of the automatic document feeder 300. Document D is loaded and supported by the feed belt 311 that is a rotatable wide endless belt and wound around the drive roller 312A and the idle roller 312B.

One end portion of the feed belt 311 is joined by a joint section so that the feed belt 311 is formed into a loop, and the other end portion of the feed belt 311 is extended outside of the joint section so that the extended portion is formed into a protruding gripper section 311B. The feed belt 311 is a cloth belt coated with resin, or a belt made of a polyethylene terephthalate (PET) film. The inner surface of the gripper section 311B of the feed belt 311 and a portion of the outer surface of the feed belt 311 are made rough so that the friction coefficients of the rough surfaces are higher than those of other surfaces, and the friction coefficient of other portion of the outer surface is low so that the surface is slippery. In this case, a portion of the feed belt 311A may be partially made to be a rough surface. For example, a portion of the outer surface of the feed belt 311 may be partially made to a rough surface composed of a plurality of small protrusions 311E, and further the surfaces of the small protrusions 311E may be made rough so that the friction coefficient is high. In this case, numeral 311C is a hole used for detection. When a reflection type sensor S13 for home position detection detects the hole 311C, the home position of the feed belt 311 can be detected, and the stop position of the gripper section 311B of the feed belt 311 can be controlled in accordance with the result of detection.

An electromagnetic brake BRK2 and an electromagnetic clutch CL4, which are connected with a sheet discharging drive motor M3, are provided at the end of the rotational shaft of the drive roller 312A. A fixed plate 313 is secured inside the feed belt 311 between the drive roller 312A and the idle roller 312B. Due to the fixed plate 313, document stack D on the feed belt 311 can be supported on a plane.

Numeral 315 is a separation means that separates a document stack stacked on the feed belt 311 from a document stack inserted below the lowermost document of the document stack, wherein the inserted documents have been circulated and conveyed after image reading processing. A separation lever 315A of the separation means 315 is pushed by a spring, and operated by the action of solenoids SL3 and SL4 so that it can be moved vertically and further in a direction perpendicular to the sheet forward direction and moreover it can be lowered diagonally.

A document stack first stacked on the document stack section 310 is loaded on the feed belt 311 and the movable pushing plate 317 that will be described later. Then, the document stack is aligned by a width stopper plate 316 that regulates the document stack in the width direction, and at the same time the leading ends of the documents come into contact with a document leading end stopper 318 so that the leading ends of the documents are aligned. At this time, the separation lever 315A is pushed downward by the weight of the document stack, so that the lowermost layer of the document stack is lightly pushed upward. An oscillatory sheet holding lever 310Z provided upstream of the separation lever 315A helps a returned document to be positively inserted below the document stack, and the document surface is lightly pressed by the weight of the sheet holding lever 310Z. The sheet holding lever 310Z is effective to stabilize the operation of the separation lever 315A when curled documents or a small number of documents are conveyed.

A separation lever push-up means 314 is provided at a position close to one edge portion of the feed belt 311 on the upstream side of the separation means 315 with respect to the feeding direction.

A solenoid SL3 is attached to a lower portion of the base plate of the separation means 315. By the action of the solenoid SL3, the separation lever 315A is moved in a direction perpendicular to the document conveyance direction. A solenoid SL4 is attached to a lower portion of the base plate of the separation lever push-up means 314. Since the push-up lever 314A comes into contact with a lower surface of the fore end portion of the separation lever 315A, the solenoid SL4 can push up the push-up lever 314A.

In an initial unloaded condition in which a document stack is not loaded on the feed belt 311 of the document stack section 310, the separation lever 315A is inclined by the weight, so that the fore end of the separation lever is raised. When the separation lever 315A is located in this raised position, the separation sensor S14 is turned off.

A document stack is loaded on the feed belt 311 of the document stack section 310 and the end portion of the separation lever 315A is lowered by the weight of the document stack. In this case, the separation lever 315A is lowered and lightly comes into contact with the lowermost sheet of the document stack. When the separation lever 315A is lowered in the aforementioned manner, the separation sensor S14 is turned on. At this time, the end portion of the sheet holding lever 310Z presses the upper surface of the document stack by its weight.

When the documents of the document stack provided on the document stack section 310 are conveyed out by the top-feed-bottom-return system, the end of the separation lever 315A is pinched between the last page of the document stack and the first page of the returned documents, and as the returned documents are increased, the end of the separation lever is gradually raised. When the first page of the returned documents has reached the uppermost position, the separation lever jumps up. At this time, the separation sensor S14 is turned off.

The separation lever 315A is withdrawn to the outside of the side edge of the document by the sucking action of the solenoid SL3. After a predetermined period of time has passed from the removal of the separation lever 315A, the solenoid SL3 is turned off. Then the separation lever 315A is moved to the document side, and the fore end of the separation lever 315A enters the cut-out portion of the feed belt 311, and is turned by its own weight and contacted with the lower surface of the document.

An actuator section (a shading plate section) is protruded from one end of the oscillatory shaft 317A. The actuator section turns on and off the optical path of the pushing home position sensor (for example, a photo-interrupter) S3 so that the home position of the drive plate 319 can be detected. The oscillating shaft 317A is connected with a drive shaft of the pushing motor M1.

The document leading end stopper 318 is secured to the automatic document feeder body at a position close to the end portion of the document flow of the movable pushing plate 317.

A feed section 320 is provided above the movable pushing plate 317. The feed section 320 includes a delivery roller 321, drive roller 323, idle roller 322, feed belt 324 provided around both rollers, and reverse roller 325 for preventing double feeding, wherein the reverse roller 325 is located below the feed belt 324. The drive force of the drive motor M2 is transmitted to the drive roller 322 through the electromagnetic clutch CL1.

A frame 321A supporting the delivery roller 321 can be freely oscillated. The actuator section is integrated with the frame 321A and protruded from its end. The actuator section turns on and off an optical path of the detection sensor S4 fixed at a predetermined position of a fixed stay member 300A of the automatic document feeder 300.

The intermediate conveyance section 330 is provided downstream of document conveyance of the feed section 320. The intermediate conveyance section 330 includes a pair of first intermediate conveyance rollers 331 that are normally rotated, curved guide plate 332, and a pair of second intermediate conveyance rollers 334. These units form a conveyance passage to convey a document D sent out from the feed section 320, to one end of the platen glass 111.

A reversal means is provided on the left of the platen glass 111 on the left of the second intermediate conveyance rollers 333. A pair of reversal conveyance rollers 335 (the drive roller 335A and idle roller 335B) are always normally rotated by the action of the one-way clutch CL5. Numeral 336 is a curved guide connecting the nip position of the second conveyance rollers 333 with that of the reversal conveyance rollers 335, and the guide 336 forms a document reversal feed passage. A reversal detection sensor (S17) is provided in a portion of the document reversal feed passage so as to detect the passing of a reversed document.

On the platen glass 111, there is provided a conveyance belt 341 that winds around the drive roller 342, idle roller 343, four document holding rollers 344, and tension roller 345. Therefore, the belt 341 can be rotated around the rollers. A clutch and brake are mounted on the shaft of the drive roller 342, and the drive roller 342 is driven by the drive force of the drive motor M2.

The sheet discharge and reversal section 350 includes sheet carrying-out rollers 351 (the drive roller 351A and the idle roller 351B), sheet carrying-out roller 352, changeover claws 353, 357, reversal conveyance rollers 354 (the drive roller 354A and the idle roller 354B), circulation sheet discharge roller 355, branch guide plate 358, and guide plates 356A, 356B, 356C. The drive rollers 351A, 354A, sheet discharge roller 352, and circulation sheet discharge roller 355 are driven by the sheet discharge motor M3. The sheet discharge roller 352 and the circulation sheet discharge rollers 355 are normally driven by the sheet discharge motor M3, and the carrying-out rollers 351 and the reversal conveyance rollers 354 are driven normally and reversely. The changeover claw 353 is driven by the changeover solenoid The changeover claw 353 is driven by the CFF changeover solenoid SL1. The changeover claw 357 is driven by the changeover solenoid SL2.

Figure 5:
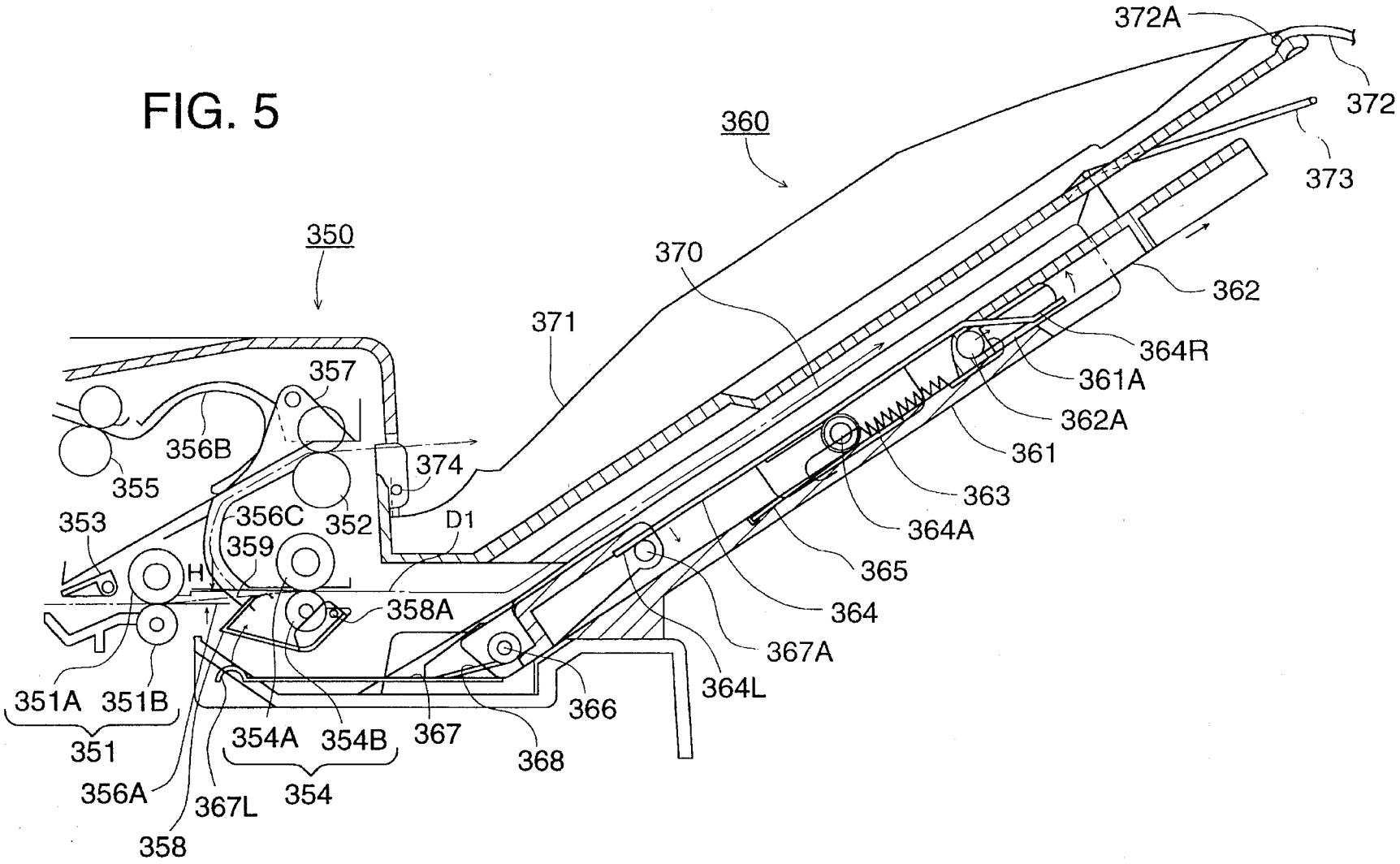
FIG. 5 is a sectional view of the sheet discharge inversion section and sheet discharge tray section of the automatic document feeder in the R-ADF mode.

FIG. 5 is a sectional view showing the primary portions of the sheet discharging and reversal section 350 and the sheet discharging tray section 360.

At a position close to the reversal conveyance rollers 354, the branch guide plate 358 is supported in such a manner that the branch guide plate 358 can be oscillated around the support shaft 358A. Usually, the branch guide plate 358 is stopped at a lower position, so that a conveyance passage is formed from the carrying-out rollers 351 to the reversal conveyance rollers 354. In the case where CFF documents are discharged, the branch guide plate 358 is oscillated when the auxiliary tray 362 movably supported by the first tray 361 is operated. Therefore, a conveyance passage formed so that a document conveyed out by the carrying-out rollers 351 is sent downward and directly discharged onto the first tray 361.

The horizontal position of the nip of the reversal conveyance rollers 354 on the downstream side of document conveyance is higher than that of the nip position of the carrying-out rollers 351 disposed on the upstream side. In this case, a difference of the nip levels is "H". Consequently, a document carried out by the carrying-out rollers 351 is guided by the branch guide plate 358 oscillated upward. Then the document is obliquely sent upward and nipped by the reversal conveyance rollers 354.

A reversal guide member 359 is fixed to a lower end of the guide plate 356C used for inverting the document. A fore end portion of the reversal guide member 359 is protruded into a document conveyance passage between the nip position of the carrying-out rollers 351 and that of the reversal conveyance rollers 354. For example, the reversal guide member 359 is made of a flexible film of polyethylene terephthalate (PET).

In the case where a document is normally conveyed, a fore end portion of the document carried out by the carrying-out rollers 351 comes into contact with a reverse side of the reversal guide member 359, and pushes out the guide member 359 and further advances. The document passes on an upper surface of the branch guide plate 358 and further passes through the guide plate 356A. Finally, the document arrives at the nip position of the reversal conveyance rollers 354.

In the case where a document is inverted, a rear end of the document nipped by the reversal conveyance roller is reversely conveyed, and comes into contact with the reversal guide member 359 which blocks the normal document passage. Then the document passes along the surface of the reversal guide member 359, and passes through the inside of the guide plate 356C. Finally, the document arrives at the circulation sheet discharge rollers 355.

In this automatic document feeder of the present invention, the upper drive roller 351A of the carrying-out rollers 351 of the sheet reversal section 350, and the reversal conveyance rollers 354 (including the drive roller 354A and the idle roller 354B), are driven by the sheet discharge motor M3 provided in the automatic document feeder. The lower idle roller 351B of the carrying-out rollers 351 is provided on the copying apparatus main body 100 side. When the reversal conveyance rollers 354 are integrated into one unit, the conveyance performance can be improved when the reversal and circulation documents are conveyed. When the carrying-out rollers 351 are composed in such a manner that they can be easily disassembled, the initial setting of a CFF document and jam clearance can be easily performed.

A sheet discharge tray section 360 is provided in the upper portion of the copying apparatus body 100 close to the sheet discharge opening of the sheet discharge reversal section 350 of the automatic document feeder 300. The sheet discharge tray section 360 includes: the first tray 361 having an inclined surface rotatably supported by the upper surface of the casing of the copying apparatus body 100; and the second tray 371 pivotally mounted on the fulcrum shaft provided at one end of the automatic document feeder 300. Under the condition that the trays are used, the inclined upper surface of the first tray 361 and the inclined lower surface of the second tray 371 maintain a predetermined interval and form a conveyance passage 370.

In the RADF mode of two-sided documents, the cut sheet document D1 sent out from the reversal conveyance rollers 354 to the sheet discharge tray 360 is conveyed in the following manner. The document D1 is conveyed in the conveyance passage 370, and the trailing end of the document D1 is detected by the sensor S11. After a predetermined period of time has passed from the detection, the document D1 is stopped under the condition that the trailing end of the document is nipped by the reversal conveyance rollers 354. Successively, the document is introduced into the automatic document feeder 300 when the reversal conveyance rollers 354 are reversed. Then, the document passes through the guide plate 356C of the discharge sheet reversal section 350, and is discharged outside by the action of the U-turn sheet discharge rollers 352. Then the discharged document is stacked on the second tray 371.

In the reversal circulation mode (R-RDH) of two-sided documents, the document D1 is conveyed in the following manner. The changeover claw 357 is switched downward. The cut sheet document D1 conveyed into the conveyance passage 370 passes through the reversal conveyance roller 354, guide plates 356C, 356B, and circulation sheet discharge rollers 355. Then the document D1 is returned onto the document stack section 310.

A long groove portion 361A is formed at a position close to the upper end of the first tray (lower tray). The long groove portion 361A is engaged with a pin 362A implanted at a position close to the lower end of the third tray (auxiliary tray) 362, so that the first tray movably supports the third tray. A tension spring 363 is provided between the first tray 361 and the third tray 362, so that the third tray 362 is pulled by the action of the tension spring 363 along the guide surface of the first tray 361.

Figure 6:
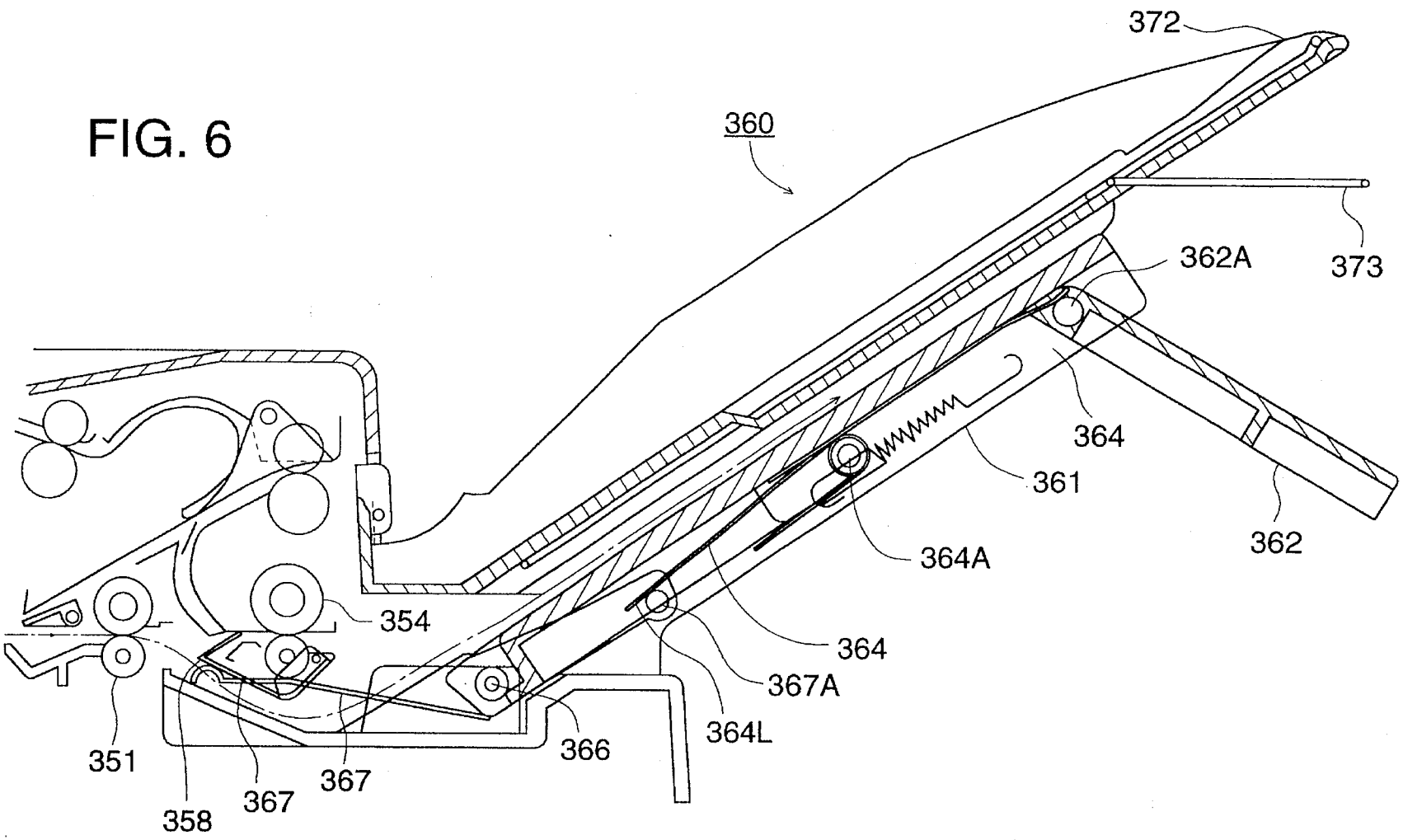
FIG. 6 is a sectional view of the sheet discharge inversion section and sheet discharge tray section of the automatic document feeder in the CFF mode.

After the third tray 362 has been pulled out obliquely upward along the long groove portion 361A, the third tray 362 can be oscillated and stopped at the upper end portion of the long groove portion 361A as shown in FIG. 6).

A shaft portion 364A of the oscillating lever 364 is inserted into a bearing provided close to the center of the lower surface of the first tray 361, so that the oscillating lever 364 is rotatably supported by the bearing. A right end portion 364R of the oscillating lever 364 comes into pressure contact with the pin 362A when the third tray 362 is pulled out. The oscillating lever 364 is energized by the spring 365, so that the right end portion 364R is located close to the pin 362.

A shaft 366 is provided at a position close to the mounting portion of the first tray 361 in the upper portion of the copying apparatus 100. The shaft 366 is inserted into a hole formed at the center of the oscillating lever 367, so that the oscillating lever 367 is rotatably supported. A pin 367A is implanted at the right end portion of the oscillating lever 367, and a left end portion 364L of the oscillating lever 364 comes into pressure contact being pushed by the spring 368. A left end portion 367L of the oscillating lever 367 is formed into a spoon-shape, and freely contacted with and separated from the lower surface of the branch guide plate 358.

The first tray 361 is supported by the shaft 366, and rotated around the shaft 366. The first tray 361 can be rotated upward and turned together with the second tray 371 described later.

The second tray (upper tray) is capable of rotating around the shaft 374. Under the condition shown in the drawing, a portion of the lower surface of the second tray 371 comes into the upper surface of the first tray 361, and a gap is provided so that a conveyance passage 370 illustrated by a one-dotted chain line can be formed. Therefore, documents conveyed out by the reversal conveyance rollers 354 can be conveyed in the passage 370.

Documents discharged by the sheet discharge roller 352 can be stacked and accommodated on the upper surface of the second tray 371.

A light extending tray 372 composed of wires is provided at an upper end portion of the second tray 371 in such a manner that it can be turned. When the extending tray 372 is developed, large-sized documents (for example, documents of A2 size) can be stacked. A guide member 373 is rotatably provided at a position a little lower than the upper end portion of the extending tray 372. The guide member 373 is also composed of wires. When documents are conveyed as illustrated in FIG. 5, the guide member 373 lightly comes into pressure contact with large-sized documents (for example, documents of A3 size) conveyed onto the third tray 362 by its own weight.

FIG. 6 is a sectional view of the sheet discharge tray 360 under the condition of CFF document conveyance.

In the CFF document conveyance mode, the third tray 362 is pulled out obliquely upward. When the third tray 362 has reached the upper dead point, the third tray 362 is lowered around the pin 362A. As a result of the above manual operation, the pin 362A slides along the long groove 361A, and pushes up the right end portion 364R of the oscillating lever 364, so that the oscillating lever 364 is rotated counterclockwise, and the left end portion 364L pushes down the pin 367A of the oscillating lever 367.

When the right end pin 367A of the oscillating lever 367 is lowered, the oscillating lever 367 is rotated clockwise around the shaft 366, resisting the force of the spring 368. The left end portion 367L moves upward and comes into pressure contact with the branch guide plate 358, so that the branch guide plate 358 is rotated clockwise around the shaft 358A. Due to the foregoing, the conveyance passage shown in FIG. 5 from the conveyance rollers 351 to the reversal conveyance rollers 354 is interrupted, and the conveyance passage under the branch guide plate 358 is opened. Therefore, documents are discharged along the locus illustrated by a one-dotted chain line.

FIGS. 7(A) to 7(E) are schematic illustrations showing the document conveyance passage of each mode. In this case, the document conveyance passage is shown by a one-dotted chain line.

Figure 7:
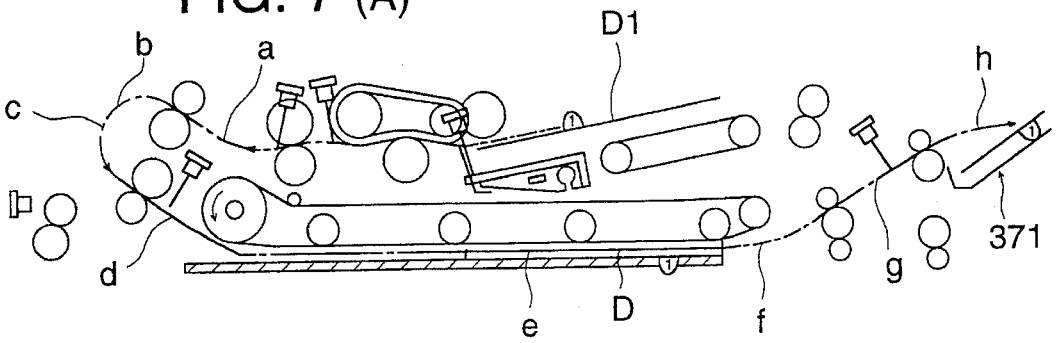
FIGS. 7(A) to 7(E) are schematic illustrations respectively showing the document conveyance passages of the modes of ADF, R-ADF, RDH, R-RDH and CFF.
Figure 7:
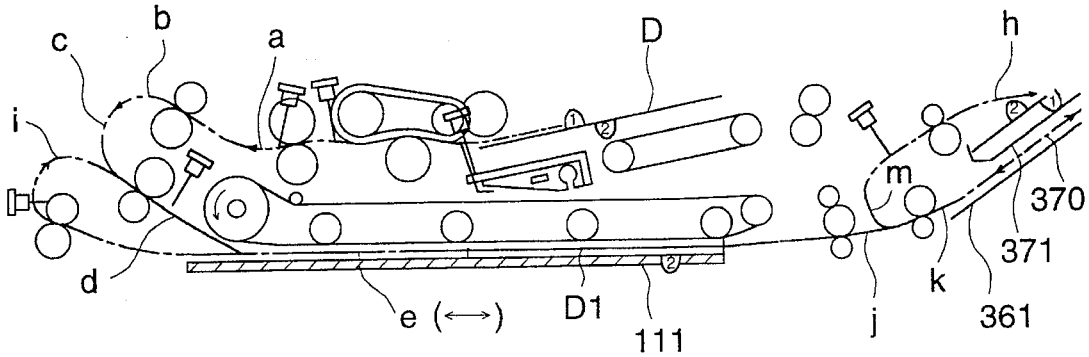
Figure 7:
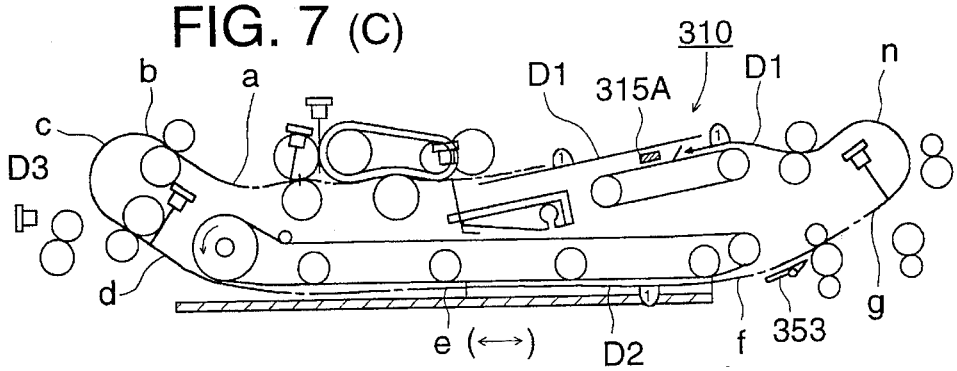
Figure 7:
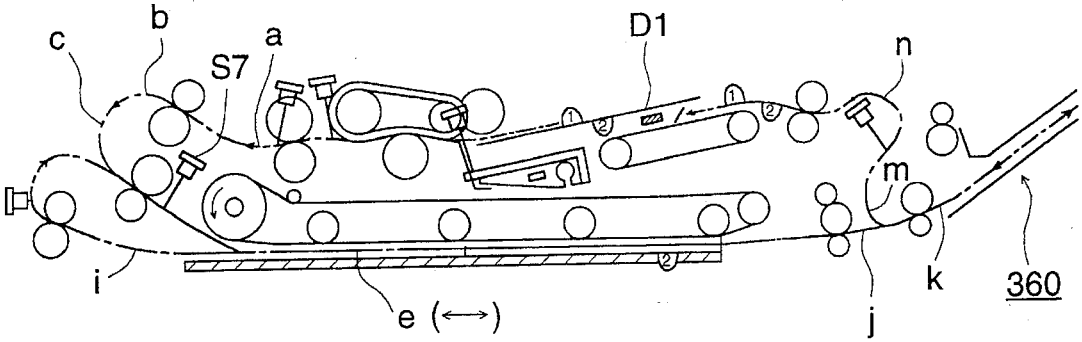
Figure 7:
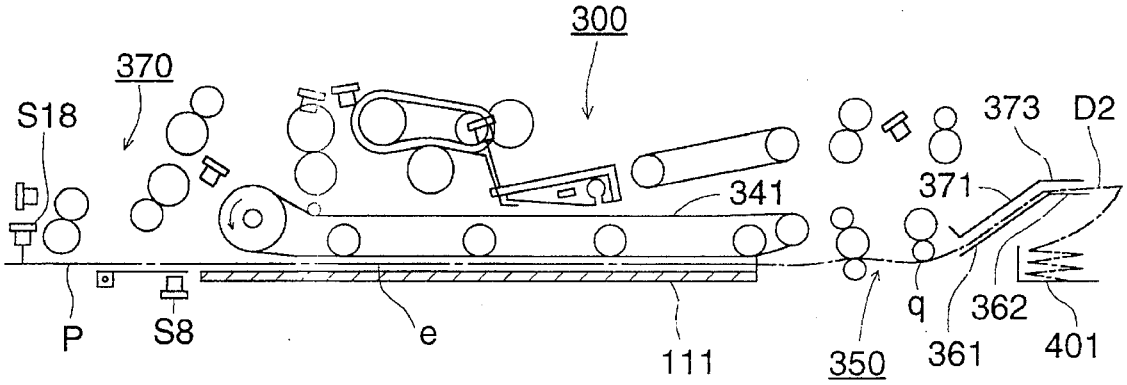

FIG. 7(A) shows the ADF mode in which one-sided documents are copied and discharged onto the sheet discharge tray section 360 disposed outside of the apparatus. The document D is successively conveyed from the document stack section 310 through the sheet conveyance passages a, b, c, d, and the conveyance passage e on the platen glass. Further, the document D is successively conveyed through the conveyance passages f, g, h. In the case of regular size documents which are smaller than A3 size, the documents are stacked and accommodated on the second tray 371. In the case of large size document such as A2 size documents, the documents are stacked and accommodated on the two surfaces on which the second tray 371 and the extending tray 372 are connected.

FIG. 7(B) shows the R-ADF mode in which two-sided documents are copied and discharged onto the sheet discharge tray 360 disposed outside of the apparatus. First, a document is successively conveyed through the sheet conveyance passages a, b, c, d and e, so that the first surface (1) of the document is exposed to light. Then the document is reversely conveyed on the platen glass 111, and inverted when it passes through the inversion loop passage (the first document conveyance passage) i. After that, the document passes again through the passages d and e, and the second surface (2) is exposed to light on the platen glass 111. After both surfaces of the document D has been exposed to light, the document D is conveyed to the sheet discharge reversal section 350, and passes through the discharge sheet passages j and k, and enters the tunnel-shaped reversal passage 370 of the sheet discharge tray section 360. After that, the document D is reversely conveyed, and passes through the reversal sheet discharge passages m and h. Then, the document D is stacked and accommodated on the second tray 371 of the sheet discharge tray section 360.

FIG. 7(C) is a schematic illustration showing the RDH mode in which one-sided documents are copied on one side of sheets. The one-sided document D successively passes through the sheet discharge passages a, b, c, d and e. After the document D has been exposed to light, it passes through the sheet discharge passages f, g, n of the sheet discharge reversal section 350. Then the document D enters the holding section 311B of the conveyance belt 311 of the document stack section 310, and the document D is conveyed by the feed belt 311 and returned to the lowermost layer of the document stack.

FIG. 7(D) is a schematic illustration showing the R-RDH mode of document circulation and conveyance in which two-sided documents are copied on both sides of copy sheets. The passage of this R-RDH mode is the same as that of the aforementioned RDH mode from the start of the operation to the exposure of an odd-numbered surface of a two-sided document. A sheet, one side of which has already been copied, is stacked in the ADU 180. Further, the document passes through the feed passages a, b, c, d. After the trailing end of the document has passed through the pair of rollers 334 and the sensor S7, the conveyance belt 341 is reversed. Then the document passes through the first document feed passage i, and the other side of the document is exposed to light in the conveyance passage e. Then the document passes through the sheet discharge passages j, k. After that, the document is switched back and passes through the reversal sheet discharge passages m, n, and is returned to the document stack section 310, wherein the posture of the document is the same as that of the original condition. In accordance with the above motion, a sheet, on the one side of which an image has already been formed, is sent out from the ADU 180. Then an image is formed on the other side of the sheet. In this way, two-sided copy sheets which have already been collated can be made. That is, in the first circulation, only one side is copied with respect to all documents, and in the second circulation, the other side is copied, so that one volume can be made. The above operation is repeated by the number of times which is the same as that of volumes to be made.

Figure 8:
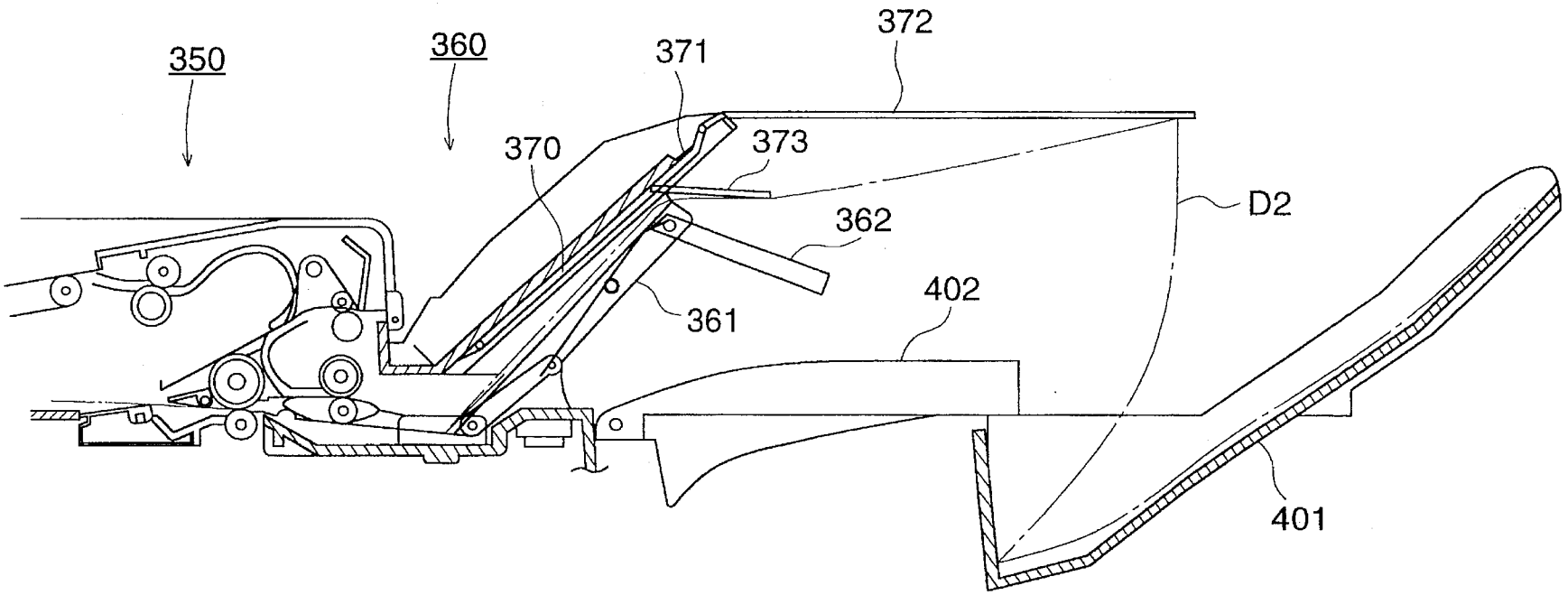
FIG. 8 is a sectional view of the sheet discharge inversion section and sheet discharge tray section of the automatic document feeder in the CFF mode.

FIG. 7(E) is a schematic illustration showing the conveyance process of a CFF document in the mode in which the CFF document D2 is copied. FIG. 8 is a sectional view of the sheet discharge reversal section 350 and the sheet discharge tray section 360 in the CFF mode. In this CFF mode, the automatic document feeder 300 is opened, and the CFF document is set on the platen glass 111, wherein the right end of the platen glass 111 is used as the reference. After that, the automatic feeder 300 is closed, and the CFF document D2 is conveyed by the conveyance belt 341 (the second document feed passage p→conveyance passage e). S18 (shown in FIGS. 2 and 4) is a sensor for detecting the perforations of the CFF document D2. The stopping position of the CFF document D2 is controlled by the detection signal of the sensor S18. The CFF document D2 is conveyed out to the sheet discharge reversal section 350 by the action of the changeover claw 353 which has previously been changed over by the solenoid SL1. The CFF document D2 is discharged outside of the sheet discharge reversal section 350 through the lower passage q of the branch guide plate 358 which has been changed over upward by the operation of the third tray 362. Then the document passes through the conveyance passage 370 formed by the first tray 361 and the second tray 371. Then, the document is discharged. In this case, the upper surface side of the document is regulated by the guide member 373. Further, the document comes into contact with the extending tray 372, and the perforation portion of the CFF document is bent, so that the document is lowered, and then the document is accommodated and stacked on the tray 401 on the uppermost tray of the FNS unit 400.

Figure 9:
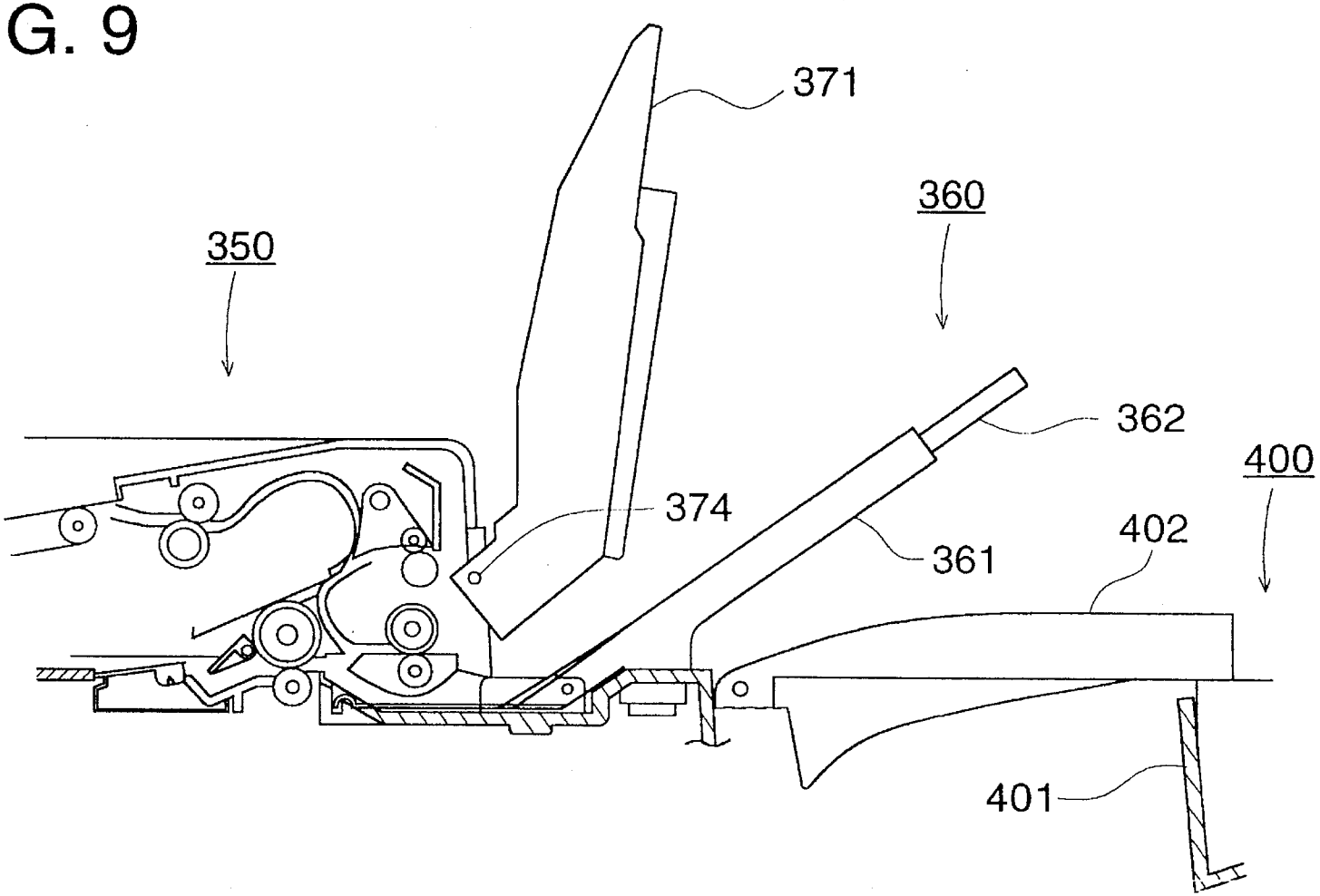
FIG. 9 is a sectional view showing a condition in which the sheet discharge tray section is opened.

FIG. 9 is a sectional view showing the circumstances in which the second tray 371 of the sheet discharge tray section 360 is oscillated so that the conveyance passage 370 formed between the first tray 361 and the second tray 371 is opened. When the fore end portion of the second tray 371 is lifted up, the second tray 371 is rotated upward around the shaft 374, so that the document conveyance passage 370 formed between the first tray 361 and the second tray 371 can be opened. Therefore, a jammed reversal document can be easily taken out.

Figure 10:
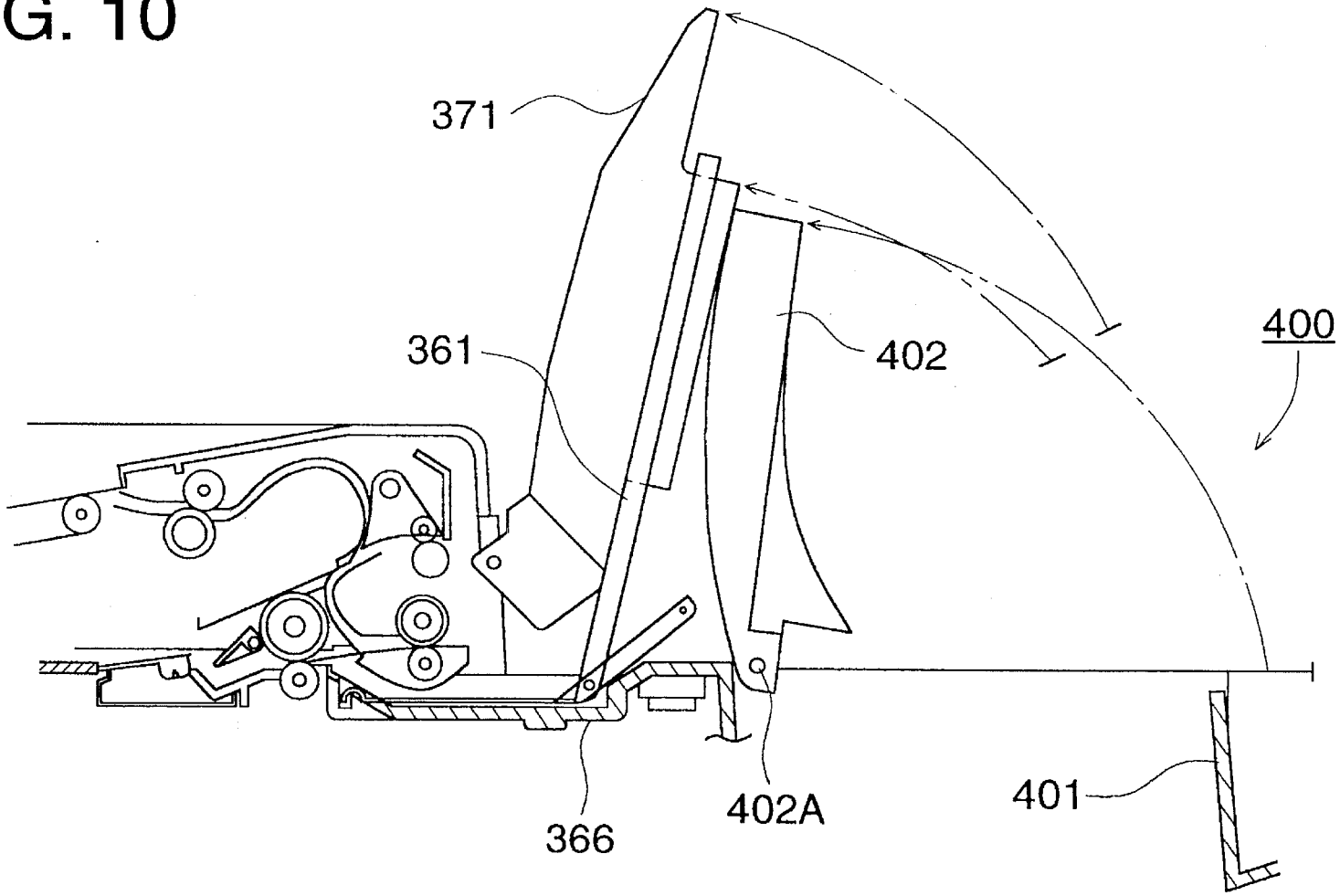
FIG. 10 is a sectional view showing a condition in which the sheet discharge tray section and the upper portion of finisher (FNS) unit are opened.

FIG. 10 is a sectional view showing the circumstances in which the upper cover 402 of the FNS device 400 is opened. As described above, the second tray 371 is opened, and then the first tray 361 is rotated around the shaft 366 so that it can be opened, and further the upper cover 402 of the FNS device 400 is opened around the shaft 402A. In this way, the FNS device can be opened upward, so that the inside of the FNS device 400 can be easily inspected. In this connection, it is possible that the first tray 361 and the second tray 371 are opened all at once when the upper cover 402 is opened.

Next, with reference to FIG. 11, the conveyance process of CFF documents D2 will be explained as follows.

Figure 11:
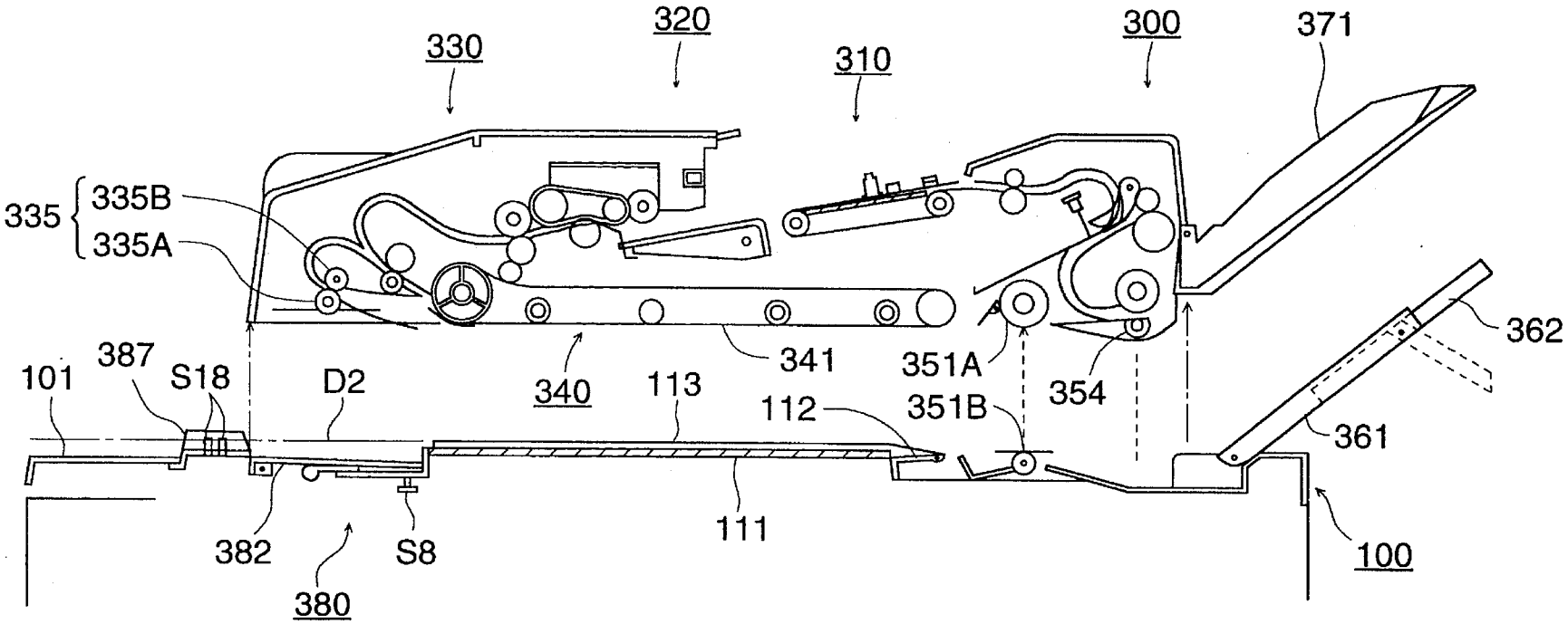
FIG. 11 is a sectional view in which the automatic document feeder is opened with respect to the main body of the copying apparatus.

FIG. 11 is a sectional schematic illustration showing the circumstances in which the RDH device 300 is opened with respect to the copier main body 100.

When the CFF documents D2 are conveyed, first, the RDH device 300 is raised and rotated around a hinge portion not shown in the drawing, so that the upper portion of the copying apparatus can be set in an open condition. In this open condition, the upper surface (the document stacking surface) of the platen glass 111 of the copying apparatus 100 is opened, and a document fore end colliding portion of the document fore end stopper 112 disposed on the discharge side, is pushed by a spring and raised to a position of a predetermined height. Numeral 113 is a plate-shaped side stopper for documents which is disposed on the platen glass 111 on the side opposite to the viewer's side. Under the above condition, the pressure plate 382 on the sheet supply side is lowered, and withdrawn downward from the upper surface of the platen glass 111. Also, the upper drive roller 351A and lower idle roller 351B of the carrying-out rollers 351 are separated from each other. That is, the drive roller 351A is located on the upper RDH device 300 side, and the idle roller 351B is located on the lower copying apparatus main body 100 side, so that the document conveyance passage j for discharging documents is opened. In this case, the second document feed passage p for feeding CFF documents is also opened which is formed between the drive roller 335A of the reversal conveyance rollers 355 and the pressure plate 382.

Under the open condition described above, the CFF document D2 is positioned in the following manner: The first CFF document D2 is set on the platen glass 111. The fore end portion of the document D2 is permitted to collide with the document fore end stopper 112, and the side end portion of the document is aligned with the document side stopper 113 and the width restricting fixed guide member 387. Further, the movable guide plate of the width direction is moved so that another side end of the document D2 comes into contact with the guide plate and the side end is aligned. In this way, the positioning operation of CFF document D2 is completed. When the document D2 is set in the above manner, the two perforations of the CFF document D2 are coincident with the sensors S18 for detecting the CFF holes.

Concerning the sheet discharge tray 360 disposed on the copying apparatus main body 100 side, the third tray 362, guide member 373 and extending tray 372, which are illustrated in FIG. 8, are oscillated so as to be laid down, and the CFF document D2 drops down through a passage formed in an upper space of the FNS device 400. Then the document D2 is accommodated in the uppermost tray 401.

After the CFF document D2 has been set in the above manner, the RDH device is lowered and stopped at the copying apparatus main body 100. Due to the foregoing, the second document feed passage p and sheet discharge side document conveyance passage j are formed, and the document fore end stopper 112 is forcibly lowered and withdrawn from the document conveyance passage j. Then the platen glass 111 is pressed by the conveyance belt 311. In this way, the preparation for conveyance of document D2 is complete.

When the copy button on the copying apparatus main body 100 side is pressed by an operator, the hand-feed pushing solenoid SL5 is energized with current, and the pressure plate 382 is raised through the leaf spring 384, so that the pressure plate 382 comes into contact with the circumferential surface of the drive roller 335A of the reversal conveyance rollers 335 with a predetermined force.

Simultaneously when the copy button is pressed, or a little after that, the scanning exposure operation is started by the scanning exposure section 110 on the copying apparatus 100 side.

In this connection, when the copy button is pressed, the timer starts its counting operation. After a predetermined period of time has passed, the timer sends an off-signal. Due to the signal, the conveyance clutch CL3 and drive motor M2 are operated, and the reversal conveyance rollers 335 and conveyance belt 341 are rotated. In this way, conveyance of the CFF document D2 is started. Synchronously with the start of conveyance of the document, the CFF changeover solenoid SL1 is turned on, and the changeover claw 353 is raised, so that the document discharge passage j is opened. Simultaneously when the timer T4 is turned off, the sheet discharge brake BRK2 and sheet discharge motor M3 are turned on, so that the CFF document D2 discharged from the platen glass 111 by the rotating conveyance belt 341 is sent to the sheet discharge passage j. Then the document is nipped by the pair of conveyance rollers 351 and the pair of reversal conveyance rollers 354, and discharged onto the first tray 361 outside of the apparatus.

In the above document conveyance process, the hand-feed pushing solenoid SL5 is turned off after a predetermined period of time. Therefore, the pressure plate 382 is lowered so as to release the pressure. After that, the CFF document D2 is conveyed at high speed V1 by the conveyance force of the conveyance belt 341 and the nip action of the pairs of rollers 351, 354.

In the process of conveyance of the CFF document D2, the CFF hole sensor S18 detects the perforations of the CFF document D2 and counts their number. For example, when the counted number reaches 20, the speed of drive motor M2 is reduced by the signal sent from the sensor, so that the document conveyance speed is switched from the high speed V1 to the middle speed V2. In this case, for example, the high speed V1 is set at 1200 mm/s, and the middle speed V2 is set at 600 mm/s.

When the final perforations on one page of the CFF document D2 are detected by the CFF hole detection sensor S18, the drive motor M2, sheet discharge motor M3 and conveyance clutch CL3 are turned off. At the same time, the conveyance brake BRK1 is turned on, and the conveyance belt 341 and reversal conveyance rollers 335 are turned off, so that the conveyance of the continuous CFF document D2 is suddenly stopped, and the second page of the CFF document D2 is stopped at a predetermined position on the platen glass 111, that is, the second page of the CFF document D2 is stopped at the stopping position at the right end on the platen glass 111 at which the perforations are to be stopped.

After the CFF document D2 has stopped, the scanning exposure operation of the second page is started.

When the perforations on the final page of the CFF document D2 are detected by the CFF hole detection sensor S18, a predetermined period of time is measured by the timer, and the drive motor M2 and sheet discharge motor M3 are turned off in the same manner as that of the first page, so that the scanning exposure operation is conducted on the final page.

After the scanning exposure of the final page has been completed, the sheet feed motor M2 and sheet discharge motor M3 are driven, and the final page of the CFF document D2 is discharged.

When the trailing end of the final page is detected by the reversal sheet discharge sensor S11 of the sheet discharge reversal section 350, the timer starts its counting operation. After a predetermined period of time has passed, the sheet feed motor M2 and sheet discharge motor M3 are stopped. In this way, the discharge operation of the CFF document D2 is completed.

The CFF document D2 discharged from the RDH device 300 in this way passes through a conveyance passage between the first tray 361 and the second tray 371, and then collides with the extending tray 372 so that the advancing direction of the document D2 is changed, and the document D2 drops down by its own weight and is accommodated in the tray 401.

As described above, the copying apparatus having the automatic document feeder of the present invention can provide the following effects.

(1) Even if a document is curled downward, the occurrence of jam can be avoided in the case where it is switched back in the reversal conveyance passage of the sheet discharge section.

(2) Since a pair of reversal conveyance rollers are disposed on the automatic document feeder side in the form of a unit, the positioning of documents can be accurately conducted with respect to the ADF main body, and the fluctuation of the nip line of upper and lower rollers can be avoided. Therefore, the occurrence of skewed conveyance can be prevented.

(3) The construction of the sheet discharge tray section can be made simple. Therefore, the reliability of document conveyance can be improved.

(4) When the upper side guide is provided in the case where CFF documents are processed, the documents do not jump out from the passage and further the occurrence of defective folding can be prevented.

(5) The conveyance properties of CFF documents can be improved.

(6) Documents can be excellently aligned on the sheet discharge tray.

(7) In the construction in which a copy sheet after-processing device is provided on the sheet discharge side of the copying apparatus, the continuous document discharged from the automatic document feeder can be stacked and accommodated on the uppermost tray of the copy sheet after-processing device. Therefore, the construction can be made simple, and further a CFF document reception stand is not required. Nevertheless, the cost can be reduced, and further the installation space can be minimized for stacking the continuous documents.

What is claimed is:

1. A copying apparatus equipped with an automatic document feeding device having a first sheet-discharging mode in which a cut-sheet document is imagewise exposed at an image reading station, conveyed to a sheet-discharging station disposed downstream from said image reading station, reversed in said sheet-discharging station, and then discharged from said automatic document feeding device, and a second sheet-discharging mode in which a continuous sheet document including a plurality of documents linked one after another in series is imagewise exposed at said image reading station, conveyed to said sheet-discharging station disposed downstream from said image reading station, and then discharged from said automatic document feeding device, said copying apparatus comprising:

(a) a pair of carrying rollers provided within said sheet-discharging station downstream from said image reading station, for conveying the cut-sheet document or the continuous sheet document;

(b) a pair of reversible conveying rollers provided within said sheet-discharging station downstream from said image reading station, for conveying the cut-sheet document conveyed from said pair of carrying rollers in a reverse direction or a forward direction, each of said pair of reversible conveying rollers being reversibly rotatable;

(c) a sheet discharge tray provided downstream from said pair of reversible conveying rollers, on which the cut-sheet document conveyed from said pair of reversible rollers is discharged; and (d) a branching guide member provided between said pair of carrying rollers and said pair of reversible conveying rollers, for branching the cut-sheet document or the continuous sheet document conveyed from said pair of carrying rollers by oscillating a fore end of said branching guide member to a lowered position or a raised position thereof, wherein when said automatic document feeding device is in the first sheet-discharging mode, said fore end oscillates to the lowered position to allow the cut-sheet document to be passed through a nip position of said reversible conveying rollers and to be reversed after being moved to and from said sheet discharge tray, and wherein when said automatic document feeding device is in the second sheet-discharging mode, said fore end oscillates to the raised position to allow the continuous sheet document to be passed through a passage below said pair of reversible conveying rollers and to be passed along and away from said sheet discharge tray.

2. The copying apparatus of claim 1, wherein said pair of reversible conveying rollers is provided in a main body of said automatic document feeding device.

3. The copying apparatus of claim 1, wherein said pair of carrying rollers includes a drive roller provided in a main body of said automatic document feeding device and an idle roller provided in a main body of said copying apparatus.

4. The copying apparatus of claim 1, wherein said sheet discharge tray is oscillatably mounted on an upper part of a main body of said copying apparatus.

5. The copying apparatus of claim 1, wherein said automatic feeding device is a recirculating document handler.

6. The copying apparatus of claim 1, wherein a nip position of said pair of reversible conveying rollers is provided at a position higher than a nip position of said pair of carrying rollers.

7. The copying apparatus of claim 6, wherein said automatic feeding device is a recirculating document handler.

8. A copying apparatus equipped with an automatic document feeding device having a first sheet-discharging mode in which a cut-sheet document is imagewise exposed at an image reading station, conveyed to a sheet-discharging station disposed downstream from said image reading station, reversed in said sheet-discharging station, and then discharged from said automatic document feeding device, a second sheet-discharging mode in which a continuous sheet document including a plurality of documents linked one after another in series is imagewise exposed at said image reading station, conveyed to said sheet-discharging station, and then discharged from said automatic document feeding device, and a third sheet-discharging mode in which a cut-sheet document is imagewise exposed at said image reading station, conveyed to said sheet-discharging station disposed downstream from said image reading station, and then discharged from said automatic document feeding device, said copying apparatus comprising:

(a) a first sheet discharge tray for temporarily storing a portion of the cut-sheet document reversed when said automatic document feeding device is in the first sheet-discharging mode, and for guiding thereon the continuous sheet document discharged from said discharging station when said automatic document feeding device is in the second sheet-discharging mode; and (b) a second sheet discharge tray provided above said first sheet discharge tray, for receiving the cut-sheet document discharged from said automatic document feeding device when said automatic document feeding device is in the first sheet-discharging mode, and for storing the cut-sheet document discharged from said automatic document feeding device when said automatic document feeding device is in the third sheet-discharging mode, wherein when said document feeding device is in the second sheet-discharging mode, the continuous sheet document discharged from said automatic feeding device is guided by a conveyance passage formed by an upper surface of said first sheet discharge tray and a lower surface of said second sheet discharge tray.

9. The copying apparatus of claim 8 further comprising:

(c) a third sheet discharge tray having a fore end supported oscillatably downward at a downstream side of said first sheet discharge tray;

(d) a first guide member supported oscillatably downward at a downstream side of said second sheet discharge tray; and (e) a second guide member supported oscillatably downward on said second sheet discharge tray, wherein when said automatic document feeding device is in the second discharging mode, the continuous sheet document discharged from said automatic document feeding device is guided by an other conveyance passage formed by the upper surface of said first sheet discharge tray, said third sheet discharge tray, said first guide member, and said second guide member.

10. The copying apparatus of claim 9 further comprising a branching guide member provided in a document conveyance passage, for branching the cut-sheet document or the continuous sheet document after being conveyed from a pair of carrying rollers, wherein said branching guide member oscillates in response to oscillation of said third sheet discharge tray so that a first document conveyance passage for the cut-sheet document reversed when said automatic document feeding device is in the first sheet-discharging mode and a second document conveyance passage for the continuous sheet document can be switched.

11. The copying apparatus of claim 8, wherein said first sheet discharge tray is oscillatably mounted on an upper part of a main body of said copying apparatus and said second sheet discharge tray is oscillatably mounted on a frame of said automatic document feeding device.

12. The copying apparatus of claim 8, wherein said automatic feeding device is a recirculating document handler.

13. A copying apparatus equipped with an automatic document feeding device in which a continuous sheet document including a plurality of foldable documents linked one after another in series is imagewise exposed at an image reading station, conveyed to a pair of sheet discharge rollers disposed downstream from said image reading station in a sheet-discharging station to be nipped therebetween, and then discharged from said automatic feeding device, said copying apparatus comprising:

(a) a first sheet discharge tray provided outside said automatic document feeding device and mounted on a main body of said copying apparatus, for receiving the continuous sheet document discharged from said automatic document feeding device, said first sheet discharge tray having a slanted guiding surface, a downstream portion of the slanted guiding surface being located at a position higher than a nip portion of said pair of sheet discharge rollers;

(b) a second sheet discharge tray mounted on said automatic document feeding device and provided above said first sheet discharge tray, for receiving a cut-sheet document discharged from said automatic feeding device, wherein the continuous sheet document discharged from said automatic document feeding device is guided by a conveyance passage formed by the slanted guiding surface of said first sheet discharge tray and a lower surface of said second sheet discharge tray; and (c) a storing tray for storing the continuous sheet document discharged from said automatic document feeding device, at least a portion of the storing tray being positioned lower than the downstream portion of the standard guiding surface, wherein the continuous sheet document is discharged obliquely upward along said slanted guiding surface and then drops into said storing tray while being folded.

14. The copying apparatus of claim 13, wherein said storing tray is an uppermost bin of a sorter provided on a side of a main body of said copying apparatus.

15. The copying apparatus of claim 13, wherein said automatic feeding device is a recirculating document handler.

* * * * *